US010518937B2

(12) United States Patent
Ackerman

(10) Patent No.: US 10,518,937 B2
(45) **Date of Patent: *Dec. 31, 2019**

(54) CLOSURE MECHANISM WITH MULTIPLE FREQUENCY FEEDBACK

(71) Applicant: S.C. Johnson & Son, Inc., Racine, WI (US)

(72) Inventor: Bryan L. Ackerman, Freeland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/059,164

(22) Filed: Aug. 9, 2018

(65) Prior Publication Data

US 2018/0346202 A1 Dec. 6, 2018

Related U.S. Application Data

(63) Continuation of application No. 15/205,030, filed on Jul. 8, 2016, now Pat. No. 10,077,140, which is a continuation of application No. 14/557,530, filed on Dec. 2, 2014, now Pat. No. 9,434,514, which is a continuation of application No. 12/844,535, filed on Jul. 27, 2010, now Pat. No. 8,926,179.

(51) Int. Cl.

| | |
|---|---|
| ***B65D 33/25*** | (2006.01) |
| ***A44B 19/16*** | (2006.01) |
| ***A44B 19/24*** | (2006.01) |

(52) U.S. Cl.

CPC ..... *B65D 33/2591* (2013.01); *A44B 19/16* (2013.01); *A44B 19/24* (2013.01); *B65D 2203/12* (2013.01); *Y10T 24/2532* (2015.01); *Y10T 24/2534* (2015.01)

(58) Field of Classification Search

CPC ..... B65D 33/2591; B65D 2203/12; A44B 19/16; A44B 19/24

USPC ..... 383/64

See application file for complete search history.

(56) References Cited

U.S. PATENT DOCUMENTS

| | | | |
|---|---|---|---|
| 4,186,786 | A | 2/1980 | Kirkpatrick |
| 4,285,105 | A | 8/1981 | Kirkpatrick |
| 4,363,345 | A | 12/1982 | Scheibner |
| 4,479,244 | A | 10/1984 | Ausnit |
| 4,736,496 | A | 4/1988 | Fisher et al. |
| 4,822,539 | A | 4/1989 | Tilman et al. |

(Continued)

FOREIGN PATENT DOCUMENTS

| | | | |
|---|---|---|---|
| JP | 2009-196658 | A | 9/2009 |

*Primary Examiner* — Jes F Pascua

(57) ABSTRACT

A closure mechanism includes a first elongate closure member having a series of spaced features disposed along an entire length of the first elongate closure member. A second elongate closure member includes a series of spaced features disposed along an entire length of the second elongate closure member. The second elongate closure member sealingly engages the first elongate closure member. A slider interacts with (i) the series of spaced features on the first elongate closure member to produce a first feedback at a first frequency, and (ii) the series of spaced features on the second elongate closure member to produce a second feedback at a second frequency. The first feedback at the first frequency differs from the second feedback at the second frequency.

10 Claims, 2 Drawing Sheets

(56) References Cited

U.S. PATENT DOCUMENTS

| | | | | |
|---|---|---|---|---|
| 4,929,487 | A | 5/1990 | Tilman et al. | |
| 5,070,584 | A | 12/1991 | Dais et al. | |
| 5,138,750 | A | 8/1992 | Gundlach et al. | |
| 5,140,727 | A | 8/1992 | Dais et al. | |
| 5,152,613 | A | 10/1992 | Herrington, Jr. | |
| 5,209,574 | A | 5/1993 | Tilman | |
| 5,211,481 | A | 5/1993 | Tilman | |
| 5,307,552 | A | 5/1994 | Dais et al. | |
| 5,382,094 | A | 1/1995 | Ausnit | |
| 5,384,942 | A | 1/1995 | Siegel | |
| 5,509,734 | A | 4/1996 | Ausnit | |
| 5,647,100 | A | 7/1997 | Porchia et al. | |
| 5,722,128 | A | 3/1998 | Toney et al. | |
| 5,774,955 | A | 7/1998 | Borchardt et al. | |
| 5,791,783 | A | 8/1998 | Porchia et al. | |
| 5,950,285 | A | 9/1999 | Porchia et al. | |
| 6,186,663 | B1 | 2/2001 | Ausnit | |
| 6,592,260 | B1 | 7/2003 | Randall et al. | |
| 6,594,872 | B2 | 7/2003 | Cisek | |
| 6,877,898 | B2 | 4/2005 | Berich et al. | |
| 6,955,465 | B2 | 10/2005 | Machacek et al. | |
| 7,137,736 | B2 | 11/2006 | Pawloski et al. | |
| 7,410,298 | B2 | 8/2008 | Pawloski | |
| 7,574,782 | B2 | 8/2009 | Ackerman | |
| 7,611,284 | B2 | 11/2009 | Borchardt et al. | |
| 7,620,859 | B2 | 11/2009 | Naso et al. | |
| 7,651,271 | B2 | 1/2010 | Withers | |
| 7,674,040 | B2 | 3/2010 | Dowd et al. | |
| 8,192,085 | B2 | 6/2012 | Pawloski et al. | |
| 8,469,592 | B2 | 6/2013 | Pawloski | |
| 8,568,031 | B2 | 10/2013 | Price et al. | |
| 8,578,572 | B2 | 11/2013 | Ackerman et al. | |
| 8,926,179 | B2 | 1/2015 | Ackerman | |
| 8,974,118 | B2 | 3/2015 | Pawloski | |
| 9,434,514 | B2 | 9/2016 | Ackerman | |
| 10,077,140 | B2 * | 9/2018 | Ackerman | A44B 19/16 |
| 2002/0153273 | A1 | 10/2002 | Mallik et al. | |
| 2004/0013323 | A1 | 1/2004 | Withers | |
| 2004/0074799 | A1 * | 4/2004 | Bell | B65D 33/2541 206/459.1 |
| 2004/0078939 | A1 | 4/2004 | Pawloski | |
| 2004/0086604 | A1 | 5/2004 | Grandey | |
| 2005/0281492 | A1 | 12/2005 | Turvey et al. | |
| 2006/0104548 | A1 | 5/2006 | Schreiter | |
| 2007/0206888 | A1 | 9/2007 | Chang | |
| 2007/0280563 | A1 | 12/2007 | Ausnit | |
| 2008/0086604 | A1 | 4/2008 | Naso et al. | |
| 2008/0159662 | A1 | 7/2008 | Dowd et al. | |
| 2010/0303390 | A1 | 12/2010 | Ackerman et al. | |
| 2011/0044566 | A1 | 2/2011 | Fish et al. | |
| 2014/0143988 | A1 | 5/2014 | Septien Rojas et al. | |
| 2015/0367995 | A1 * | 12/2015 | Turvey | A44B 19/262 383/64 |
| 2016/0059997 | A1 * | 3/2016 | Tseng | B65D 33/2591 383/64 |

* cited by examiner

CLOSURE MECHANISM WITH MULTIPLE FREQUENCY FEEDBACK

CROSS REFERENCE TO RELATED APPLICATIONS

This application is a continuation application of U.S. patent application Ser. No. 15/205,030, filed Jul. 8, 2016, now U.S. Pat. No. 10,077,140, issued Sep. 18, 2018, which is a continuation of U.S. patent application Ser. No. 14/557,530, filed Dec. 2, 2014, now U.S. Pat. No. 9,434,514, issued Sep. 6, 2016, which is a continuation of U.S. patent application Ser. No. 12/844,535, filed Jul. 27, 2010, now U.S. Pat. No. 8,926,179, issued Jan. 6, 2015.

FIELD OF THE INVENTION

The present disclosure generally relates to a closure mechanism with a slider, such as generally used on a resealable pouch, that produces multiple frequency feedback to a user when actuated.

BACKGROUND OF THE INVENTION

Resealable pouches in the form of thermoplastic bags with elongate zipper-type closure mechanisms with sliders have been developed, wherein the slider facilitates occluding and de-occluding of the closure mechanism. In some pouches, the slider interacts with grooves or projections disposed on or adjacent to the closure mechanism to produce a tactile and/or audible sensation as the slider is actuated and moved across the closure mechanism.

In one example, disclosed in Toney et al. U.S. Pat. No. 5,722,128, which is hereby incorporated by reference in its entirety, a closure mechanism includes opposing interlocking profiles and a slider engaged therewith. The closure mechanism of Toney includes deformed and undeformed segments disposed in at least one of the profiles. A portion of the slider interacts with the deformed and undeformed segments when the slider is moved along the profiles to provide a tactile and audible sensation to a user.

In another example, a closure mechanism includes opposing interlocking strips and a series of projections disposed on the interlocking strips. The series of projections represents a recorded audio pattern, that, when engaged by a slider, produces an intelligible, audible message. In the present example, different, but complementary, recorded patterns may be disposed on both interlocking strips to produce a stereo effect when the slider is moved therealong.

SUMMARY OF THE INVENTION

According to one example, a closure mechanism includes a first elongate closure member that sealing engages with a second elongate closure member. A slider slides along the first and second elongate closure members to engage or to separate the first and second elongate closure members. Further, the first elongate closure member includes a first series of regularly spaced features that interacts with the slider to produce a first feedback at a first frequency and the second elongate closure member includes a second series of regularly spaced features that interacts with the slider to produce a second feedback at a second frequency. The first feedback and the second feedback are produced simultaneously when the slider is slid along the first and second elongate closure members.

In another example, a pouch includes sidewalls that define a mouth, and first and second elongate closure members are disposed proximate to the mouth. The first elongate closure member sealingly engages with the second elongate closure member. The pouch also includes a slider that slides along the first and second elongate closure members to close or to open the first and second elongate closure members. Further, the first elongate closure member includes a first series of regularly spaced features that interacts with the slider to produce a first feedback at a first frequency and the second elongate closure member includes a second series of regularly spaced features that interacts with the slider to produce a second feedback at a second frequency. The first feedback and the second feedback are produced simultaneously when the slider is slid along the first and second elongate closure members.

In yet another example, a method of opening or closing a pouch, which includes first and second opposing elongate closure strips and a slider for opening and closing the first and second opposing elongate closure strips, includes the steps of sliding the slider from a first end of the closure strips toward a second end of the closure strips, creating a first feedback at a first regular frequency by sliding the slider, and simultaneously, creating a second feedback at a second regular frequency, by sliding the slider.

Other aspects and advantages of the present disclosure will become apparent upon consideration of the drawings and the following detailed description, wherein similar structures have similar reference numbers.

DETAILED DESCRIPTION OF THE PREFERRED EMBODIMENTS

Figure 1:
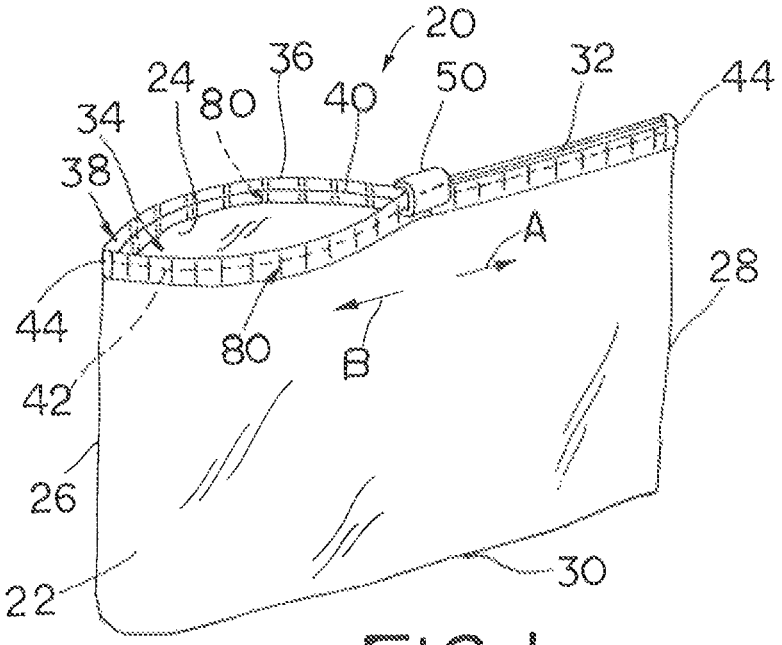
FIG. 1 is an isometric view of a pouch with a slider zipper according to one example.
Figure 2:
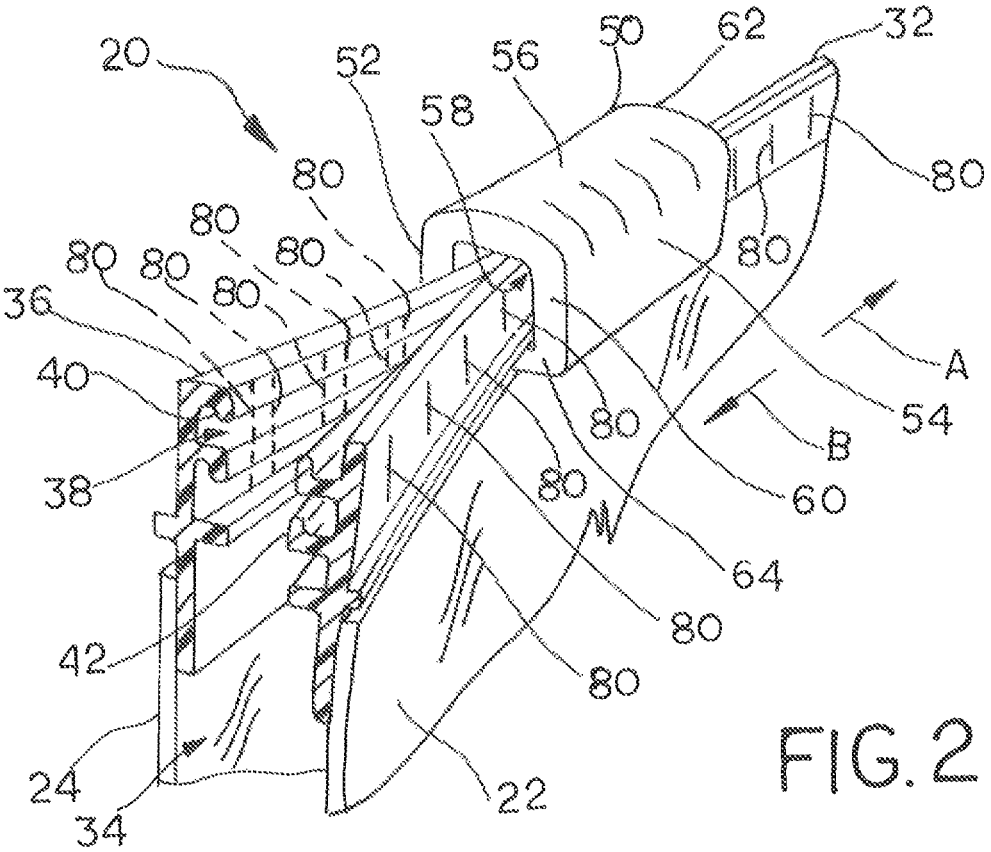
FIG. 2 is an enlarged partial cutaway view of the slider zipper of FIG. 1.
Figure 3:
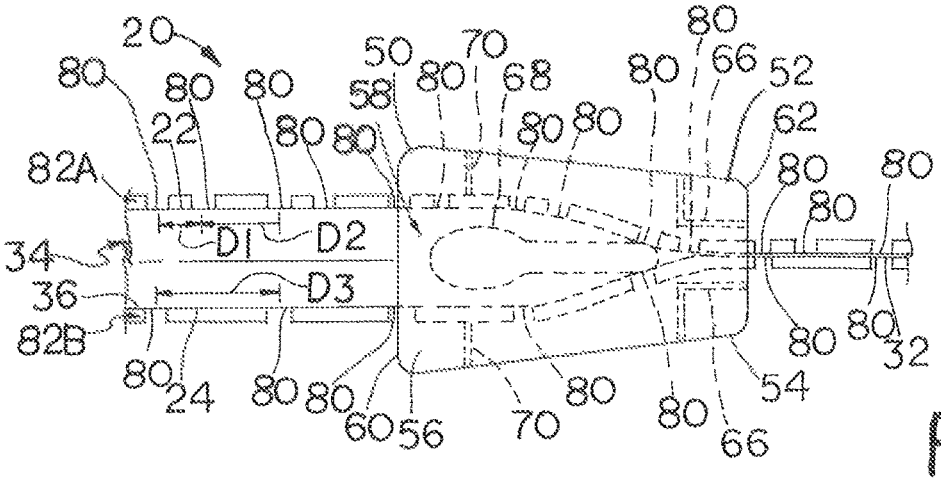
FIG. 3 is a partial top plan view of the slider zipper of FIG. 1 with portions of a closure mechanism omitted for clarity.

Turning now to FIGS. 1, 2, and 3, a pouch 20 includes a tactile and/or audible feedback mechanism that produces a unique multi-frequency feedback, such as a harmonic sound, when the pouch is opened and closed by a slider. The pouch 20 includes a first sidewall 22 and a second sidewall 24 that are connected together along peripheral side edges 26, 28, and a bottom edge 30, but unconnected along a top edge 32, to define an interior space 34 and an openable mouth 36 along the top edge. The pouch 20 can be made from any suitable material, such as paper, foil, and/or flexible thermoplastic, and the sidewalls 22, 24 may be connected in any suitable manner, such as folding, heat sealing, and/or adhesive.

An elongate closure mechanism 38 is disposed along the first and second sidewalls 22, 24 across substantially the entire length of the mouth 36 to allow the mouth to be selectively sealed and opened. The closure mechanism 38 may include any elongate sealing members sufficient to releasably close the mouth 36 along the length of the closure mechanism, such as elongate resealable closure strips. Preferably, the closure mechanism 38 includes first and second interlocking members 40, 42, wherein each of the interlocking members includes a strip having an elongate closure profile that is disposed along the mouth 36 of the pouch 20 and projects inwardly toward the other interlocking member. The elongate closure profiles of the first and second interlocking members 40, 42 may include one or more interlocking hook profiles and/or male and female profiles. However, the closure mechanism 38 of the present invention is not limited to any specific configuration of closure profiles, and may include other shapes and/or numbers of closure profiles that, preferably, would form a seal across the mouth 36 of the pouch 20. Some examples of closure mechanisms that may be adapted for use as described herein are illustrated in Pawloski U.S. Pat. No. 7,410,298 and Pawloski et al. U.S. Pat. No. 7,137,736, which are hereby incorporated by reference in their entireties. Other contemplated resealable members may include adhesive strips, hook and loop fasteners, and other inter-engaging mechanisms sufficient to releasably close and open the mouth 36. Further, the closure mechanism 38 may be integral with or separate and attached to the respective first and second sidewalls 22, 24.

The pouch 20 may be modified in various ways without departing from the spirit of the present invention. For example, the pouch 20 may include side and/or bottom gusseted portions (not shown), and the closure mechanism 38 may include sealed end portions 44 to help to prevent the sidewalls 22, 24 from separating at the edges of the mouth 36, and to help to prevent a slider from becoming disengaged from the pouch.

The pouch 20 further includes a slider 50 that is coupled to the mouth 36 so as to slide therealong in an opening direction A and in a closing direction B, opposite to the opening direction, for opening and closing the closure mechanism 38. The slider 50 includes generally parallel, opposing sidewalls 52, 54 that are spaced from each other and coupled together by a top wall 56 to define a channel 58 therebetween with first and second ends 60, 62, respectively. The mouth 36, including the interlocking members 40, 42 and top edge 32 of the sidewalls 22, 24, are disposed within the channel 58. The slider 50 may also include retention bars 64 that extend inwardly from bottom portions of the sidewalls 22, 24 and engage portions of the pouch 20 to help to maintain the slider thereon.

Referring more particularly to FIG. 3, the slider 50 also includes features to close or to occlude the closure mechanism 38 of the pouch 20 when slid in the closing direction B, and to separate or to de-occlude the closure mechanism when slid in the opening direction A. Generally, such features include closure bars 66 to press the interlocking members 40, 42 together when the slider 50 is slid in the closing direction B. The closure bars 62 may extend downwardly from the top wall 56 and/or inwardly from the sidewalls 52, 54. The slider 50 also includes a separator member 68 to separate the closure mechanism 38 when slid in the opening direction A. In the present example, the separator member 68 extends downwardly from the top wall 56 so that the separator member 68 is forced between the interlocking members 40, 42 to separate the members, the closure bars 62 are disposed proximate to the second end 62 of the slider 50, and the separator member 68 is spaced from the closure bars towards the first end 60. In other examples, however, the positioning and/or configuration of the closure bars 62 and the separator member 68 may be modified, while still providing features for occluding and de-occluding the closure mechanism 38. The slider 50 shown in FIG. 3 further includes projections or fingers 70 that extend inwardly from the side walls 52, 54, and which may be configured to engage with a feedback mechanism on the closure mechanism 38, as will be described in more detail hereafter.

Other sliders suitable to be adapted for use with the present disclosure are disclosed in Toney, supra, Porchia et al. U.S. Pat. No. 5,950,285, and Ackerman U.S. Pat. No. 7,574,782, each of which is hereby incorporated by reference in its entirety. Other types and/or designs of sliders may also be adapted for use with a pouch and/or closure mechanism consistent with the present disclosure.

The closure mechanism 38 of the present disclosure further includes a plurality of features that interacts with the slider 50 to produce feedback at a particular frequency. The features can take any form sufficient to engage with portions of the slider 50 in a manner that will produce the feedback at frequencies as disclosed in detail herein, such as protrusions and indentations. In the present example, the features have the form of indentations 80, such as vertically oriented slits, that interact with portions of the slider 50 to provide tactile and/or audible feedback, such as sound and/or vibrations, to a user when the slider 50 is moved along the closure mechanism. In FIGS. 1, 2, and 3, the indentations 80 are disposed along an outer surface of the interlocking members 40, 42 and are spaced from each other at one or more regularly repeating intervals. In other embodiments, the indentations 80 may be disposed along a top edge and/or inner surface of the interlocking members 40, 42. Further, the indentations 80 are illustrated as being generally rectangular in shape. In other embodiments, however, the indentations may be any other shape suitable for providing the feedback, such as arcuate or V-shaped. The indentations 80 may be defined, at least in part, by protrusions or ridges that interact with one or more portions of the slider 50 to provide the tactile and/or audible feedback, as would be apparent to one of skill in the art. The feedback mechanism may be formed on the closure mechanism 38 by any known means, such as with a deformation wheel, knives, or bars using heat and/or pressure.

In the example of FIGS. 1 to 3, the first interlocking member 40 includes a first series 82A of regularly spaced indentations 80 that interacts with the slider 50 to produce a first sound at a first frequency, and the second interlocking member 42 includes a second series 82B of regularly spaced indentations 80 that interacts with the slider to produce a second sound at a second frequency. The first sound and the second sound are produced simultaneously when the slider 50 is slid along the first and second interlocking members 40, 42. The indentations 80 may also provide a tactile response simultaneously or alternatively when the slider 50 moves along the closure mechanism 38.

More particularly, and referring to FIG. 3, the first series 82A of indentations 80 includes adjacent indentations that are grouped in pairs. Each indentation 80 of a pair is separated by a distance D1 from the other indentation, and each pair of indentations is separated from an adjacent pair by a distance D2. In the present example, D1 is greater than D2. Each indentation 80 in the second series 82B of indentations 80 is spaced from an adjacent indentation by a distance D3. In the present example, D3 is greater than D1 and D2. According to one example, D1 is about 0.1 cm, D2 is about 0.4 cm, and D3 is about 0.5, but other spacings may be used within the context of the present disclosure. In another example, D3 is greater than D1 and less than D2, wherein D1 is about 0.12 cm, D2 is about 0.44 cm, and D3 is about 0.15 cm.

In use, the slider 50 is slid along the interlocking members 40, 42 from one end of the closure mechanism 38 toward the other end, and portions of the slider, such as the fingers 70, resiliently engage and bend slightly against the outer surface of the interlocking members. When the fingers 70 reach the indentations 80, the fingers 70 snap back to provide a tactile and/or audible feedback to the user. Because the indentations 80 of the first series 82A and the second series 82B are separated by different distances, the interaction of the slider 50 with the first series 82A produces feedback, such as a sound, at a different frequency than the interaction of the slider with the second series 82B. The spacings between the indentations 80 of the first and second series 82A, 82B may be modified to produce unique and complex harmonic chords that further enhance the tactile and/or audible feedback to a user when the user actuates the slider 50. Because the indentations are regularly spaced along the entire length of the closure mechanism 38, the harmonic chords can remain unchanged along the length of the closure mechanism.

Figure 4:
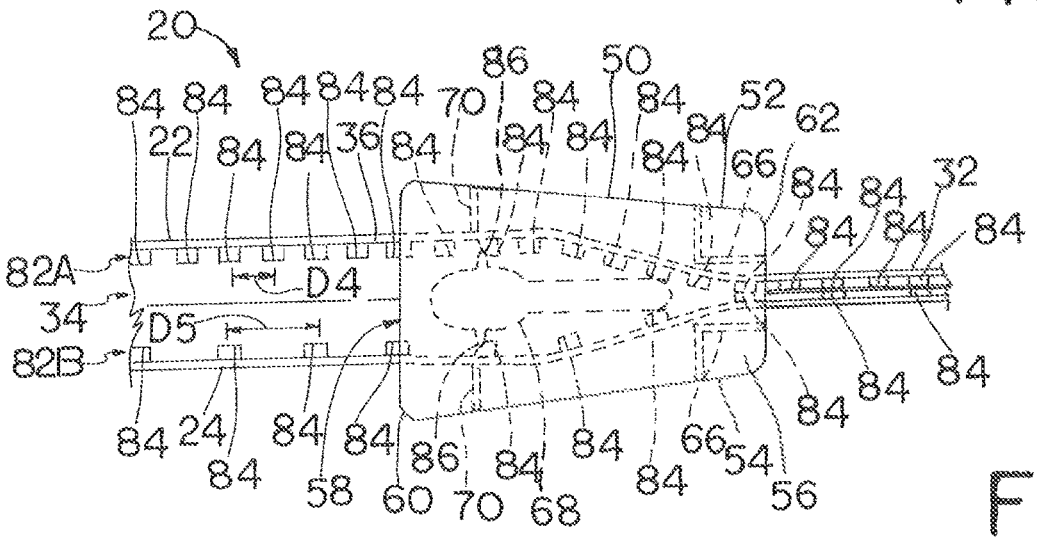
FIG. 4 is a partial top plan view, generally similar to that shown in FIG. 3, and showing another slider zipper.

Referring now to FIG. 4, another example of the feedback mechanism includes protrusions 84 disposed along an inner surface of the interlocking members 40, 42. As would be apparent to one of ordinary skill in the art, the protrusions 84 also can be considered to be defined by spaced apart indentations 80. Consequently, the terms indentations 80 and protrusions 84 are intended to be without limitation and can generally be used interchangeably to describe structures and features that comprise the tactile/audible feedback mechanism. In FIG. 4, and similar to the embodiment shown in FIG. 3, the first interlocking member 40 includes a first series 82A of regularly spaced protrusions 84 that interacts with the slider 50 to produce a first sound at a first frequency and the second interlocking member 42 includes a second series 82B of regularly spaced protrusions 84 that interacts with the slider to produce a second sound at a second frequency. The first sound and the second sound are produced simultaneously when the slider 50 is slid along the first and second interlocking members 40, 42. More particularly, each protrusion 84 of the first series 82A is spaced from an adjacent protrusion by an equal distance D4 and each protrusion of the second series 82B is spaced from an adjacent protrusion by an equal distance D5, wherein D5 is greater than D4. According to one example, D4 is about 0.2 cm and D5 is about 0.5 cm, although other spacings may be used within the context of the present disclosure.

In use, the slider 50 is slid along the interlocking members 40, 42 and portions of the slider, such as, projections or fingers 86 that extend outwardly from the separator member 68, bend slightly as the slider 50 is slid past the protrusions 84. As the fingers 86 slide past the protrusions 84, the fingers snap back to provide a tactile and/or audible feedback to a user. Because the protrusions 84 of the first series 82A and the second series 82B are separated by different distances, the interaction of the slider 50 with the first series 82A produces feedback, such as a sound, at a different frequency than the interaction of the slider with the second series 82B. As noted above, the spacing between the protrusions 84 of the first and second series 82A, 82B can be modified to produce unique and complex harmonic chords that further enhance the tactile and/or audible feedback to a user when actuating the slider 50. In another embodiment, the protrusions 84 may be disposed on outer surfaces of the closure mechanism 38, as depicted generally in FIGS. 1 to 3.

Figure 5:
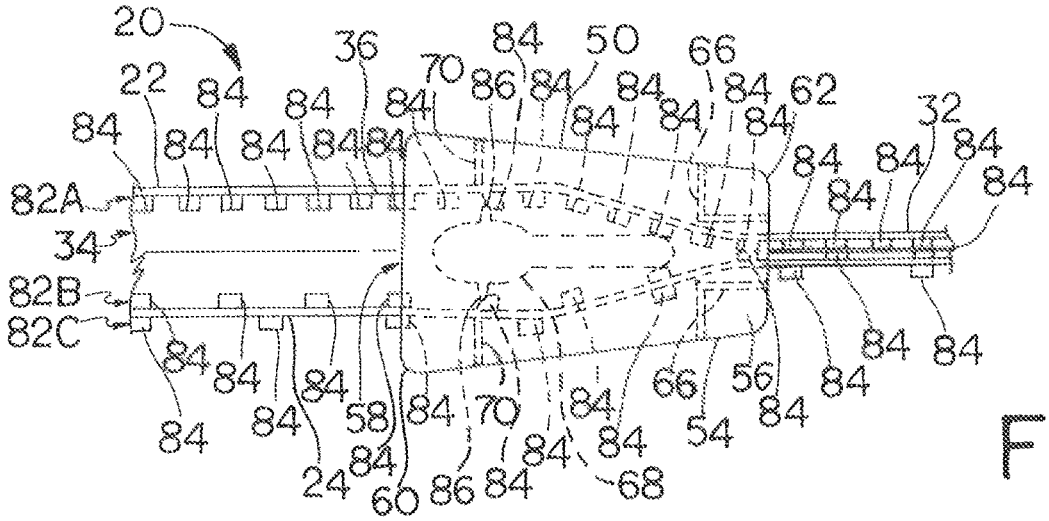
FIG. 5 is a partial top plan view, generally similar to those shown in FIGS. 3 and 4, and showing yet another slider zipper.

FIG. 5 illustrates an example similar to that shown in FIG. 4, with the addition of a third series 82C of protrusions 84 disposed on an outer surface of the second interlocking member 42. Each protrusion 84 of the third series 82C is spaced from an adjacent protrusion by an equal distance D6, wherein D6 is greater than D5 and D4. In one example, D4 is about 0.2 cm, D5 is about 0.5 cm, and D6 is about 0.6 cm, although other spacings may be used within the context of the present disclosure. In other examples, the third series 82C may be disposed on the first interlocking member 40. Alternatively, each of the series 82A-82C may be disposed on one of the interlocking members, such as along an inner surface, a top edge, and an outer surface of one of the interlocking members 40, 42. Further, an additional series 82 of protrusions 80 may be disposed on other portions of the interlocking members 40, 42 to produce feedback, such as audible harmonic chords comprising different notes and frequencies, when the slider 50 is actuated.

In use, the slider 50 is slid along the interlocking members 40, 42, and portions of the slider, such as fingers 70 and 86, resiliently engage and bend slightly as the slider 50 is slid past the protrusions 84. As the fingers 86 slide past the protrusions 84, the fingers snap back to provide a tactile/audible feedback to the user. Because the protrusions 84 of the first series 82A, the second series 82B, and the third series 82C are separated by different distances, the feedback produced by the interaction of the slider 50 with the series 82A-82C has different frequencies. As noted above, the spacing between the protrusions 84 of the first and second series 82A, 82B can be modified to produce unique and complex harmonic chords that further enhance the tactile and/or audible feedback to a user when actuating the slider 50. In addition, different distances between and configurations of features of the feedback mechanism can be used to produce a relatively constant multi-frequency feedback consistent with the scope of the present disclosure.

Other embodiments of the disclosure, including all of the possible different and various combinations of the individual features of each of the foregoing described embodiments, are specifically included herein.

INDUSTRIAL APPLICABILITY

A tactile and/or audible feedback mechanism of the present invention may be disposed on various portions of a closure mechanism, wherein a slider interacts with the feedback mechanism to produce a unique feedback when the slider is actuated therealong. Such feedback can be both pleasing to the user and provide a more noticeable or distinctive feedback to the user than a single frequency feedback mechanism. Further, the regularity of the feedback may be less confusing to the user than a complex "recorded sound," and, thereby, function more effectively to indicate successful actuation of the slider on the closure mechanism.

While specific embodiments are discussed herein, it is understood that the present disclosure is to be considered only as an exemplification of the principles of the disclosure. Numerous modifications to the present disclosure will be apparent to those skilled in the art in view of the foregoing description, without departing from the principles of the disclosed invention. Accordingly, this description is to be construed as being illustrative only, and is presented for the purpose of enabling those skilled in the art to make and to use the disclosure, and to teach the best mode of carrying out the same.

I claim:

1. A closure mechanism comprising:

a first elongate closure member that includes a series of spaced features being disposed along an entire length of the first elongate closure member, the series of spaced features being disposed on at least one of (i) an outer surface of the first elongate closure member and (ii) an inner surface of the first elongate closure member, the series of spaced features being spaced apart along the entire length of the first elongate closure member, with each feature of the series of spaced features being spaced a distance D1 from an adjacent feature of the series of spaced features, such that the distance D1 between each feature and the adjacent feature is the same along the entire length of the first elongate closure member;

a second elongate closure member that includes a series of spaced features being disposed along an entire length of the second elongate closure member, the series of spaced features being disposed on at least one of (i) an outer surface of the second elongate closure member and (ii) an inner surface of the second elongate closure member, the series of spaced features being spaced apart along the entire length of the second elongate closure member, with each feature of the series of spaced features being spaced a distance D2 from an adjacent feature of the series of spaced features, such that the distance D2 between each feature and the adjacent feature is the same along the entire length of the second elongate closure member, the distance D1 being greater than the distance D2, and the second elongate closure member being configured to sealingly engage the first elongate closure member; and a slider that slides along the first and second elongate closure members to engage or to separate the first and second elongate closure members, such that portions of the slider engage with (i) the series of spaced features on the first elongate closure member to produce a first feedback at a first frequency, and (ii) the series of spaced features on the second elongate closure member to produce a second feedback at a second frequency, as the slider is slid along the first and second elongate closure members, wherein the first feedback at the first frequency differs from the second feedback at the second frequency due to the distance D1 between each of the spaced features of the series on the first elongate closure member being greater than the distance D2 between each of the spaced features of the series on the second elongate closure member.

2. The closure mechanism of claim 1, wherein the series of spaced features on the first elongate closure member includes a plurality of vertically extending indentations on the at least one of (i) an outer surface of the first elongate closure member and (ii) an inner surface of the first elongate closure member.

3. The closure mechanism of claim 1, wherein the series of spaced features on the second elongate closure member includes a plurality of vertically extending indentations on the at least one of (i) an outer surface of the second elongate closure member and (ii) an inner surface of the second elongate closure member.

4. The closure mechanism of claim 1, wherein the first and second feedbacks produce an audible sound.

5. The closure mechanism of claim 1, wherein the slider comprises a first projection that engages the series of spaced features on the first elongate closure profile and a second projection that engages the series of spaced features on the second elongate closure member.

6. A pouch comprising:

sidewalls that define a mouth;

a first elongate closure member disposed proximate to the mouth, the first elongate closure member including a series of spaced features being disposed along an entire length of the first elongate closure member, the series of spaced features being disposed on at least one of (i) an outer surface of the first elongate closure member and (ii) an inner surface of the first elongate closure member, the series of spaced features being spaced apart along the entire length of the first elongate closure member, with each feature of the series of spaced features being spaced a distance D1 from an adjacent feature of the series of spaced features, such that the distance D1 between each feature and the adjacent feature is the same along the entire length of the first elongate closure member;

a second elongate closure member disposed proximate to the mouth, the second elongate closure member including a series of spaced features being disposed along an entire length of the second elongate closure member, the series of spaced features being disposed on at least one of (i) an outer surface of the second elongate closure member and (ii) an inner surface of the second elongate closure member, the series of spaced features being spaced apart along the entire length of the second elongate closure member, with each feature of the series of spaced features being spaced a distance D2 from an adjacent feature of the series of spaced features, such that the distance D2 between each feature and the adjacent feature is the same along the entire length of the second elongate closure member, the distance D1 being greater than the distance D2, and the second elongate closure member being configured to sealingly engage the first elongate closure member; and a slider that slides along the first and second elongate closure members to close or to open the first and second elongate closure members, such that portions of the slider engage with (i) the series of spaced features on the first elongate closure member to produce a first feedback at a first frequency, and (ii) the series of spaced features on the second elongate closure member to produce a second feedback at a second frequency, as the slider is slid along the first and second elongate closure members, wherein the first feedback at the first frequency differs from the second feedback at the second frequency due to the distance D1 between each of the spaced features of the series on the first elongate closure member being greater than the distance D2 between each of the spaced features of the series on the second elongate closure member.

7. The pouch of claim 6, wherein the series of spaced features on the first elongate closure member includes a plurality of vertically extending indentations on the at least one of (i) an outer surface of the first elongate closure member and (ii) an inner surface of the first elongate closure member.

8. The pouch of claim 6, wherein the series of spaced features on the second elongate closure member includes a plurality of vertically extending indentations on the at least one of (i) an outer surface of the second elongate closure member and (ii) an inner surface of the second elongate closure member.

9. The pouch of claim 6, wherein the first and second feedbacks produce an audible sound.

10. The pouch of claim 6, wherein the slider comprises a first projection that engages the series of spaced features on the first elongate closure profile, and a second projection that engages the series of spaced features on the second elongate closure member.

* * * * *